US005490400A

United States Patent [19]

Kim et al.

[11] Patent Number: 5,490,400

[45] Date of Patent: Feb. 13, 1996

[54] VIBRATION-ISOLATING APPARATUS FOR A CLOTHES WASHING MACHINE AND METHOD OF ASSEMBLY

[75] Inventors: Young G. Kim; Woon G. Hur; Byeong S. Ye, all of Suwon, Rep. of Korea

[73] Assignee: Samsung Electronics Co., Ltd., Suwon, Rep. of Korea

[21] Appl. No.: 355,193

[22] Filed: Dec. 8, 1994

[30] Foreign Application Priority Data

Dec. 14, 1993 [KR] Rep. of Korea ..... 93-27684 U

[51] Int. Cl.[6] ..... D06F 37/20

[52] U.S. Cl. ..... 68/23.3; 68/131; 248/594; 248/613; 248/638

[58] Field of Search ..... 68/131, 23.3; 248/613, 248/610, 638, 594

[56] References Cited

U.S. PATENT DOCUMENTS

| | | | |
|---|---|---|---|
| 4,423,608 | 1/1984 | Funaki | 68/23.3 |

FOREIGN PATENT DOCUMENTS

| | | | |
|---|---|---|---|
| 52-41472 | 3/1977 | Japan | 68/23.3 |
| 52-56770 | 5/1977 | Japan | 68/23.3 |
| 52-56771 | 5/1977 | Japan | 68/23.3 |
| 52-62978 | 5/1977 | Japan | 68/23.3 |
| 62-277997 | 12/1987 | Japan | 68/23.3 |
| 63-61036 | 11/1988 | Japan | 68/23.3 |
| 2-114996 | 4/1990 | Japan | 68/23.3 |

*Primary Examiner*—Frankie L. Stinson
*Attorney, Agent, or Firm*—Burns, Doane, Swecker & Mathis

[57] ABSTRACT

A clothes washing machine includes an outer tank, a plurality of vertical suspenders hung by their upper ends adjacent respective corners of the tank, and a water container disposed within the tank and supported at lower ends of the suspenders. The upper ends of the suspenders are secured to a cover member which is attached to an upper end of the tank. The upper end of each suspender projects through a rib-reinforced hole formed in the cover and is secured to the cover by a cap-pin fastener device. A unit constituted by the cover, suspenders, and water container can be tested prior to being installed in the tank.

5 Claims, 2 Drawing Sheets

VIBRATION-ISOLATING APPARATUS FOR A CLOTHES WASHING MACHINE AND METHOD OF ASSEMBLY

BACKGROUND OF THE INVENTION

This invention relates to a clothes washing machine, and more particularly, to a vibration-isolating apparatus of a single vessel type washing machine that absorbs vibrations produced during the operation of the machine.

A single vessel type washing machine, which includes a housing with a top opening, a water container and a wash tub therein, is an apparatus for automatically washing and dehydrating laundry.

The wash tub is disposed in the water container to form a space therebetween for containing wash water, and a pulsator which is mounted on the bottom of the wash tub.

A driving motor and a power transmission for providing a driving force for rotating the wash tub and the pulsator, and a clutch for engaging or disengaging the driving motor with the power transmission are mounted under the wash tub, whereby a rotating force is selectively transmitted to the wash tub and the pulsator.

By means of the above driving unit, the pulsator is slowly osillated in right and left turns during the washing and rinsing processes, and at the dehydrating process the wash tub is rotated at high speed to dehydrate laundry. Therefore, excessive noise is created by the vibrations produced when the pulsator or the wash tub is rotated with washing water and laundry. Most of the troubles of a clothes washing machine are caused by these vibrations.

Accordingly, a vibration-isolating apparatus is mounted inside the clothes washing machine in order to absorb such vibrations.

FIG. 1 illustrates a conventional vibration-isolating apparatus for absorbing vibrations produced when a single vessel type washing machine is in operation.

As shown in FIG. 1, a conventional vibration-isolating apparatus comprises a plurality of water container suspenders 2 arranged at each corner of the interior cabinet 1, caps 4 and fixing pins 3 for mounting each water container suspender 2 on the top of the cabinet 1, a plurality of brackets 6 which have guide holes 7 in the center and are attached to each corner of the top cabinet 1, and air dampers 5 fitted to the bottom end of each water container suspender 2.

While the diameter of the upper portion of the cap 4 is larger than that of the guide hole 7, the diameter of the lower portion of the cap 4 is smaller than that of the guide hole 7, and therefore, the lower portion of the cap 4 is inserted into the guide hole 7, and the upper portion of the cap 4 hangs on the bracket 6.

The cap 4 has a through hole 9 which passes through the cap 4 in a longitudinal direction, and a groove 10 which is formed transversely across the top surface of the cap 4. The through hole 9 joins the groove 10 at the center of the groove 10.

On the upper portion of each water container suspender 2, a hole 8 having a diameter a little larger than that of the fixing pin 3 is transversely formed to receive the fixing pin 3.

The parts of the above conventional vibration-isolating apparatus are assembled to each other as follows:

The upper portion of the cap 4 is put on the bracket 6 and the lower portion of the cap 4 is inserted into the guide hole 7 formed in the center of the bracket 6. The air damper 5 which is engaged to the bottom end of the suspender 2 is inserted into a hole (not shown) provided at the bottom of the water container (not shown), and the top end of the suspender 2 passes through the through hole 9 of the cap 4 and extends somewhat above the aligned with top of the cap 4 such that the hole 8 of the suspender 2 becomes aligned with the groove 10 formed on the top surface of the cap 4. In this state, the fixing pin 3 is then inserted into the hole 8 of the suspender 2 passing through the groove 10 of the cap 4, so that the water container is suspended on the cabinet 1.

By using such a structure, the vibrations produced when the washing machine is in operation is not only absorbed by the air damper 5, but is also isolated from the cabinet 1 of the washing machine.

However, the above conventional vibration-isolating apparatus has several disadvantages in that it requires numerous manufacturing processes and parts due to the fact that the bracket 6 for supporting the top end of the suspender 2 must be welded or screwed on the cabinet 1 of the washing machine.

In case that the bracket 6 is welded to the cabinet 1, thermal deformation of the cabinet 1 may be caused by the welding process.

Also, vibrations and noises are inevitably produced when vertical and horizontal vibration generated by the rotation of the pulsator and the wash tub, are directly transmitted to the cabinet 1 through the suspender 2 and the bracket 6. Accordingly, if the washing machine is used for a long period, the bracket 6 will eventually break.

Further, the conventional vibration-isolating apparatus has a big disadvantage during the manufacturing processes due to the bracket structure. That reason will be described in detail below.

The automatic manufacturing processes of a single vessel type washing machine having the conventional vibration-isolating apparatus begins with the assembly of the cabinet 1. In this process, the bracket 6 is welded on the cabinet 1, and an opening for connecting electric wires is formed in the lower portion of the cabinet 1. Next, the water container and the wash tub equipped with a driving motor are put into the cabinet 1, and then the opposite ends of the suspender 2 are connected to the water container and the cabinet 1, respectively.

After these steps, a top cover having a control system therein is connected to the top of the cabinet 1, and the electric wire-connecting work between the control system and the driving unit is performed through the opening formed in the cabinet 1.

Finally, after the operating tests of the washing machine are performed, and the opening for connecting electric wires is closed, the manufacture of the washing machine is finished.

As indicated in the above description, the electric wire-connecting work is very troublesome, and so the electric wires may be incorrectly connected. As well, additional work on the opening for the electric wire-connecting work is required. It is because the electric wire-connecting work can be only carried out through the opening in the state that the water container, the cabinet 1, and the top cover are completely assembled.

Further, because the operating tests are performed in the state of the top cover being connected with the cabinet 1, not only is it somewhat troublesome to perform the operating tests, but also in order to repair any disqualified portions, the assembled washing machine must be disassembled.

SUMMARY OF THE INVENTION

The first object of this invention is to provide a vibration-isolating apparatus which not only reduces effectively the vibrations produced when a single vessel type washing machine is in operation, but also does not transmit the vibrations to the cabinet of the washing machine.

The second object of this invention is to provide a vibration-isolating apparatus in which the supporting structure for the top end of a water container suspender is strengthened.

The third object of this invention is to provide a vibration-isolating apparatus for which the structure is simplified, thereby improving the manufacturing processes of a washing machine.

The vibration-isolating apparatus of a single vessel type washing machine in accordance with this invention comprises a plurality of water container suspenders disposed at each corner of the interior of the washing machine cabinet, air dampers fitted to the bottom end of each water container suspender in order to absorb the vibrations produced when the washing machine is in operation, a plurality of first holes formed at the bottom of the water container in order to connect the bottom end of each water container suspender with the water container, a plurality of second holes formed at each corner of a top cover in order to receive the top end of each water container suspender, and a plurality of caps and fixing pins placed in the second holes in order to support the top end of the water container suspenders movably in the upward direction.

Further, in order to protect the top cover from impact due to the shaking of the water container suspenders, a plurality of stiffeners are formed around the second holes which are formed on the top cover.

As can be understood from the above description, the top end of the water container suspenders are not hung directly on the cabinet, like a conventional vibration-isolating apparatus, but are hung directly on the top cover. Accordingly, the brackets, which are used in the conventional vibration-isolating apparatus, are not necessary, so the number of parts and manufacturing processes are reduced.

Because the top cover is made from a plastic material using an injection moulding method, the second holes and the stiffeners are easily formed on the top cover without any additional work.

By using stiffeners, the top cover can stand up against the vibrations produced when the washing machine is in operation.

Also, because the top end of the water container suspenders are hung on the top cover, the vibrations are not directly transmitted to the cabinet, and if an additional vibration-isolating material like rubber is mounted between the top cover and the cabinet, the vibrations are further reduced.

Additional desired effects can be obtained by hanging the water container suspenders on the top cover and this will improve the manufacturing processes of a clothes washing machine.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
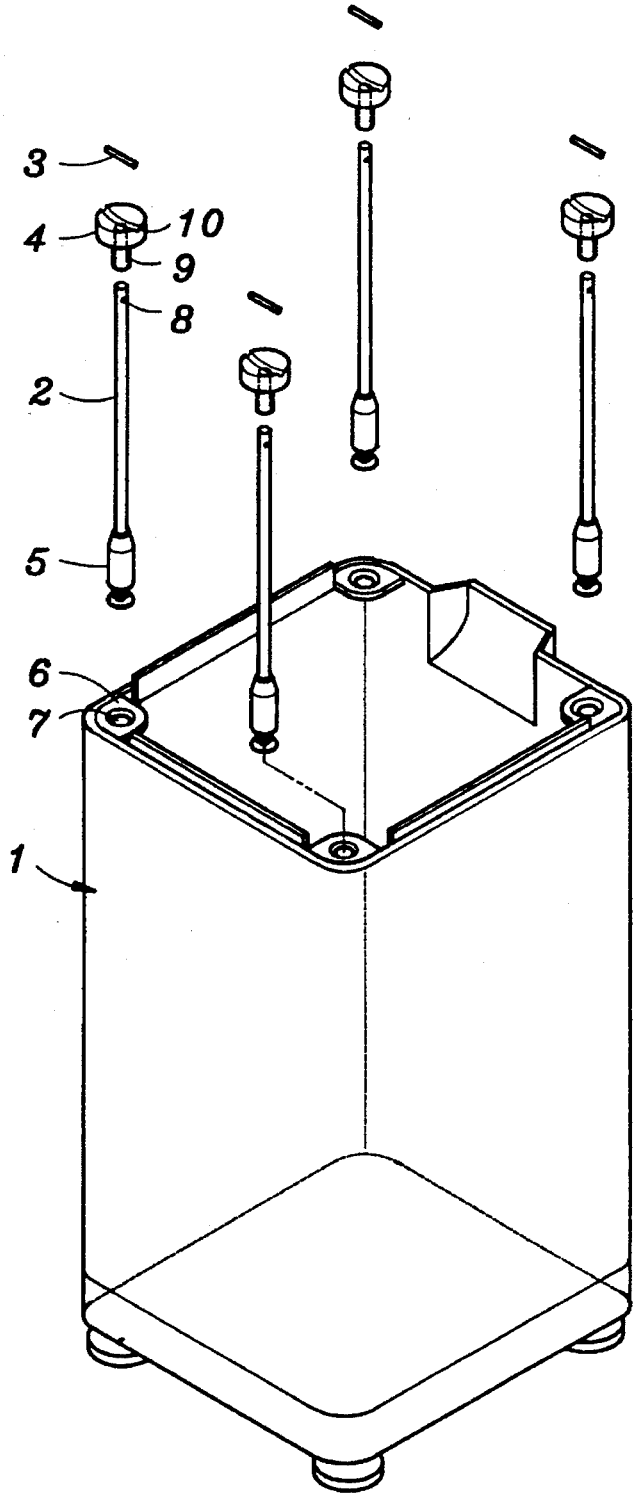
FIG. 1 (PRIOR ART)
FIG. 1 is an exploded perspective view of a conventional vibration-isolating apparatus for a single vessel type washing machine.
Figure 2:
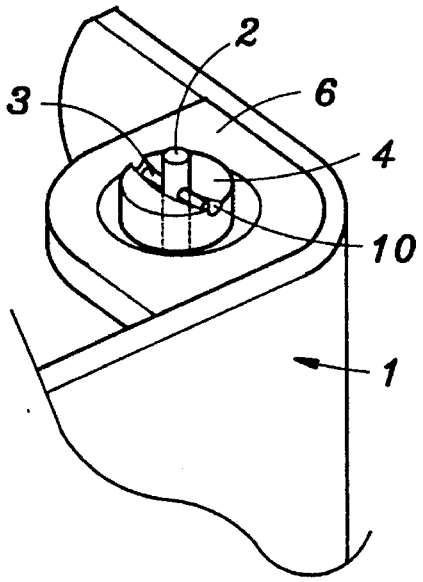
FIG. 2 (PRIOR ART)
FIG. 2 is a partial enlarged view of FIG. 1, which shows how the top end of a water container suspender is conventionally connected with the outer cabinet of a clothes washing machine.
Figure 3:
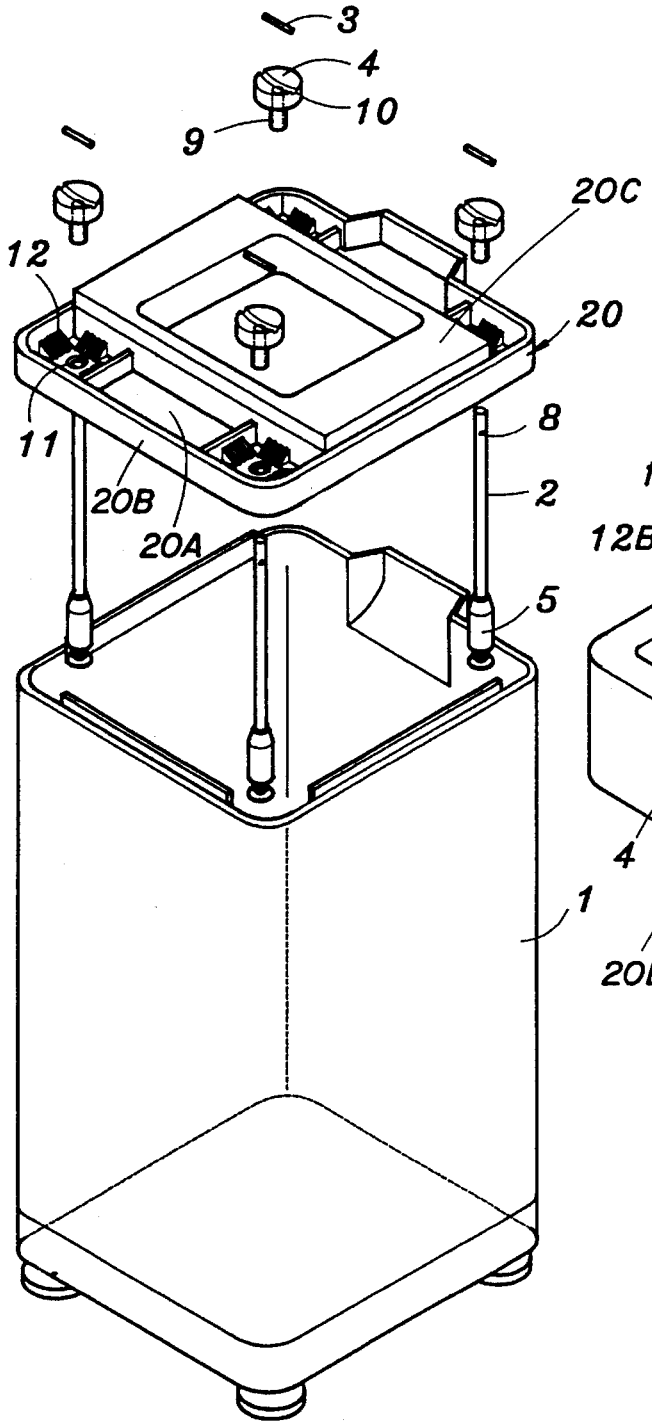
FIG. 3 is an exploded perspective view of a vibration-isolating apparatus for a single vessel type washing machine in accordance with this invention.

FIG. 3 shows a vibration-isolating apparatus for a single vessel type washing machine in accordance with this invention. In FIG. 3, the inner structure of a single type washing machine, does include a water container which is connected with the bottom end of the water container suspenders 2, but is not shown because it is the same as a conventional one. For convenience, the same parts of this invention, as are the parts of the conventional vibration-isolating apparatus shown in FIGS. 1 and 2, are designated with the same numbers.

The vibration-isolating apparatus in accordance with this invention includes a plurality of water container suspenders 2 (hereinafter called "suspender") for supporting a water container (not shown) from a cabinet or outer tank 1 in a manner that the vibrations produced when the machine is in operation are not transmitted to an outer cabinet 1. Air dampers 5 are fitted in each suspender 2 for absorbing the vibrations, and caps 4 and fasteners in the form of fixing pins 3 connect the top end of each suspender 2 to a plastic top cover 20. The top cover 20 includes a portion 20A overlying an upper open end of the cabinet 1, a vertical rim 20B defining an outer perhipery of the cover, and a central raised portion 20C of the portion 12A.

In the bottom of the water container, a plurality of first holes (not shown) are formed for receiving the bottom ends of the suspenders 2. The diameter of the first holes is larger than that of the suspender 2 and is smaller in diameter than that of the air damper 5.

The suspenders 2 are then inserted upward from the bottom of the first holes and are connected to the top cover 20. This is so that the water container is supported on the air dampers 5.

At each corner of the top cover 20, a plurality of second holes 11 are formed for receiving the top ends of the suspenders 2.

The lower portion of the cap 4 is inserted into the second hole 11, and the top end of the suspender 2 extends into the cap 4 passing through a through hole 9 which is formed on the cap 4 in longitudinal direction such that the hole 8 which is formed on an upper portion of the suspender 2 aligns with groove 10 which is formed across the head surface of the cap 4.

Next, the fixing pin 3 is inserted into the hole 8 of the suspender 2 through the groove 10 on the cap 4, so that the suspender 2 is supported by the top cover 20.

The structure such as that of a suspender 2 supported by the cap 4 and fixing pin 3 on the second hole 11, is the same as the prior art which has been described in detail in connecting with FIGS 1 and 2. Therefore, further description on thereof will be omitted.

Figure 4:
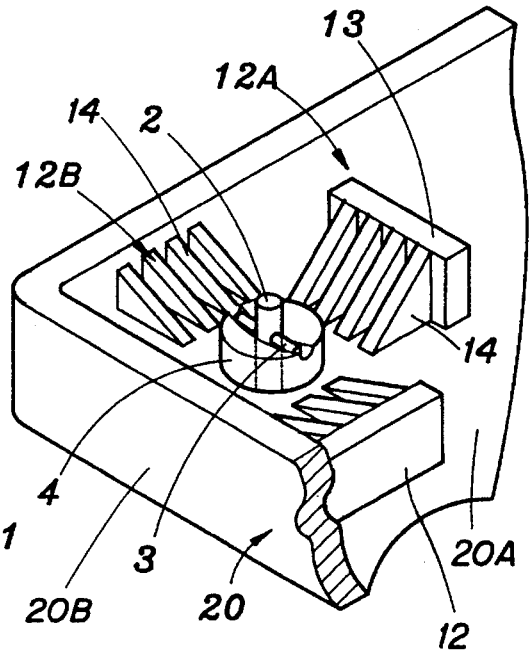
FIG. 4 is a partial enlarged view of FIG. 3, which shows how the top end of a water container suspender is connected with the top cover of a clothes washing machine in accordance with the invention.

Looking at FIG. 4, in order to protect the top cover 20 from impact due to the shaking of the suspenders 2, a plurality of stiffeners 12A, 12B are provided around each second hole 11 and are formed on the top cover 20.

Each of two stiffereners 12A comprises a frame 13 and a plurality of ribs 14 which are attached to the inner wall of the frame 13, the frame extending perpendiculary relative to the cover portion 20A. Another stiffener 12B comprises ribs 14 projecting from the rim 20B of the cover.

By using these stiffeners 12, any breakage around the second holes 11, due to continuous vibrations produced when the clothes washing machine is in operation, can be effectively prevented.

In the case where vibration-isolating rubbers are provided between each second hole 11 and each cap 4, and/or between the top cover 20 and the cabinet 1, the vibrations will be completely absorbed so that any noise created due to the vibrations of the cabinet 1 is prevented.

Furthermore, the assembly work of the outer cabinet 1 becomes much easier because the top end of the suspender 2 is supported by the top cover 20.

In the manufacturing processes of the single vessel type clothes washing machine in accordance with this invention, first,the bottom end of the suspender 2 is connected to the water container which is equipped with a driving unit on its bottom, and then the top end of the suspender 2 is connected to the top cover 20 on which the second holes 11 and stiffeners 12 are both formed by an injection moulding method, so that the top cover 20 and the water container are linked by the suspender 2. In this state, the electric wire-connecting work for connecting electric wires from the control system to the driving unit is performed, and then the operating tests for the assembled washing machine are carried out. After that, the outer cabinet 1 is assembled thereon. The single vessel type clothes washing machine in accordance with this invention is manufactured using the above processes.

As you can see from the above description, by means of the vibration-isolating apparatus in accordance with this invention, the assembly work can be easily and correctly carried out, and consequently any rejected portions can be quickly repaired during the operating tests because all electric wire-connecting work and operating tests are performed in the opened state where the outer cabinet 1 has not been assembled yet.

What is claimed is:

1. In a clothes washing machine comprising a cabinet in which a water container is supported at a lower end of a vibration-isolating apparatus that is connected to said cabinet; said apparatus including a cover, vertical suspenders, and fasteners for securing the suspenders to the cover; said cover being mounted on an upper end of said cabinet such that a portion of said cover extends across an upper open end of said cabinet; each of said vertical suspenders having upper and lower ends, said lower ends carrying respective air dampers for absorbing vibrations of said water container during machine operation; said fasteners securing said upper ends of respective suspenders to said cover, the improvement wherein:

holes are formed in said cover through which said upper ends of respective suspenders project upwardly;

caps overlie respective ones of said holes, with said upper ends of said suspenders projecting through respective ones of said caps;

said fasteners comprise fixing pins extending transversely through respective ones of said caps and said upper ends of respective suspenders to secure said suspenders to said cover; and said cover includes a plurality of stiffener rib structures arranged around each of said holes for reinforcing said cover in the vicinity of said holes, each stiffener rib structure comprising a part extending substantially perpendicularly from said portion of said cover which extends across said upper open end of said cabinet, and a plurality of horizontally spaced ribs projecting from said part and extending toward a respective hole, each rib engaging said portion of said cover.

2.In the clothes washing machine according to claim 1, wherein said parts extend upwardly from a top surface of said portion of said cover.

3. In the clothes washing machine according to claim 1, wherein at least one of said parts comprises a frame spaced from an outer periphery of said cover.

4. In the clothes washing machine according to claim 1, wherein at least one of said parts comprises a rim of said cover defining an outer periphery of said cover.

5. In the clothes washing machine according to claim 1, wherein said cover is formed of plastic.

* * * * *